US008097208B2

(12) United States Patent
Smith

(10) Patent No.: US 8,097,208 B2
(45) Date of Patent: Jan. 17, 2012

(54) WHITE COPPER-BASE ALLOY

(75) Inventor: Geary R. Smith, Lisle, IL (US)

(73) Assignee: G&W Electric Company, Blue Island, IL (US)

( * ) Notice: Subject to any disclaimer, the term of this patent is extended or adjusted under 35 U.S.C. 154(b) by 86 days.

(21) Appl. No.: 12/540,126

(22) Filed: Aug. 12, 2009

(65) Prior Publication Data

US 2011/0038752 A1 Feb. 17, 2011

(51) Int. Cl.
*C22C 9/01* (2006.01)
*C22C 9/00* (2006.01)

(52) U.S. Cl. ..... 420/471; 420/480

(58) Field of Classification Search ..... 420/480–486, 420/471

See application file for complete search history.

(56) References Cited

U.S. PATENT DOCUMENTS

| | | | | |
|---|---|---|---|---|
| 1,874,617 | A | 8/1932 | Price | |
| 1,988,938 | A | 1/1935 | Corson | |
| 4,242,131 | A | 12/1980 | Shapiro et al. | |
| 4,242,132 | A | 12/1980 | Shapiro et al. | |
| 4,242,133 | A | 12/1980 | Shapiro et al. | |
| 4,402,906 | A | 9/1983 | Ueda et al. | |
| 4,631,171 | A | 12/1986 | McDonald et al. | |
| 4,632,806 | A | 12/1986 | Morikawa et al. | |
| 4,879,094 | A | 11/1989 | Rushton | |
| 5,242,657 | A | 9/1993 | Sahu | |
| 5,330,712 | A | 7/1994 | Singh | |
| 5,344,606 | A | 9/1994 | Brimmer | |
| 5,360,591 | A | 11/1994 | Ruetz et al. | |
| 5,487,867 | A | 1/1996 | Singh | |
| 5,653,827 | A | 8/1997 | Kramer et al. | |
| 5,885,376 | A | 3/1999 | Suzuki et al. | |
| 5,985,055 | A | 11/1999 | Bhargava | |
| 6,059,901 | A | 5/2000 | Sahu | |
| 6,149,739 | A | 11/2000 | Smith | |
| 6,264,764 | B1 | 7/2001 | Kamf et al. | |
| 2002/0108256 | A1 * | 8/2002 | Egelund et al. | 30/147 |
| 2003/0110601 | A1 | 6/2003 | Sugimoto et al. | |
| 2004/0136860 | A1 | 7/2004 | Fujita et al. | |
| 2004/0140022 | A1 | 7/2004 | Inohana et al. | |
| 2006/0289094 | A1 | 12/2006 | Zhang et al. | |
| 2008/0283353 | A1 | 11/2008 | Holderied et al. | |

FOREIGN PATENT DOCUMENTS

| | | |
|---|---|---|
| CN | 1948531 | 4/2007 |
| JP | 63100144 | 5/1988 |
| JP | 63213628 | 9/1988 |
| JP | 6479333 | 3/1989 |
| JP | 1116042 | 5/1989 |
| JP | 2002260631 | 9/2002 |
| JP | 2003119527 | 4/2003 |
| WO | 2006136065 | 12/2006 |

OTHER PUBLICATIONS

"EPA Registers Copper-containing Alloy Products" www.epa.gov/pesticides/factsheets/copper-alloy-products.htm (May 2008).

Weaver, L. et al. "Survival of *Clostridium difficile* on copper and steel: futuristic options for hospital hygiene" Journal of Hospital Infection 68(2):145-151 (Feb. 2008).

Wilks, S. et al. "Survival of *Listeria monocytogenes* Scott A on metal surfaces: Implications for cross-contamination" International Journal of Food Microbiology 111(2):93-98 (Sep. 1, 2006).

* cited by examiner

*Primary Examiner* — Jessica L Ward
*Assistant Examiner* — Alexander Polyansky
(74) *Attorney, Agent, or Firm* — Michael Best & Friedrich LLP

(57) ABSTRACT

A white bronze alloy consisting essentially of, in weight percent, about 0.3-1.5 wt % aluminum, about 0.5-2.0 wt % bismuth, about 61-66 wt % copper, about 0.0-0.5 wt % iron, about 11-15 wt % manganese, about 4.0-6.0 wt % nickel, about 0.5-2.0 wt % tin, and about 16-20 wt % zinc, as well as incidental amounts of impurities. The alloy is expected to have antimicrobial properties which make the alloy desirable for fabrication into food handling equipment and products for hospitals, bathrooms, and kitchens.

9 Claims, No Drawings

WHITE COPPER-BASE ALLOY

BACKGROUND

Copper alloys, e.g., bronze, may comprise a number of additional metals, including, but not limited to, tin, phosphorus, manganese, zinc, bismuth, iron, nickel and aluminum. By varying the percent composition of the metals, new alloys are achieved with different hardness, ductility, color, strength, etc. Copper alloys typically have a yellow-red color when newly cast, but may change to shades of green as a patina develops on the surface.

While it has been know for some time that the properties of copper alloys may be altered with addition of different elements, it has only recently been possible to produce copper alloys that are "white" or have a chromed-metal-like appearance and do not form a patina. One such white copper alloy is described in U.S. Pat. No. 6,149,739, issued Nov. 21, 2000, and incorporated herein by reference in its entirety. White copper alloys filled a long-felt need for metals which are easy to work and have low galling characteristics, but present a "clean" appearance (i.e., no patina). Such alloys were quickly adopted in sanitary settings, such as food handling, which required low galling and a clean appearance.

Recently, it has been discovered that elemental copper, and higher-copper content alloys have inherent antimicrobial properties. While the exact mechanism for this property is still the subject of intense research, one theory is that the copper surfaces interact with the outer membrane of bacteria to cause disruptive leakage of cytoplasm, and ultimately cell death. In view of these independent laboratory results, and following additional rigorous testing under U.S. Environmental Protection Agency (EPA)-approved protocols, the EPA certified 275 copper alloys (including brasses and bronzes) as public health antimicrobial products in 2008. Products made with these alloys, and approved for particular applications, such as hospital bed rails, may be marketed as "kills 99.9% of bacteria within two hours."

SUMMARY

The invention provides, among other things, a white bronze alloy consisting essentially of, in weight percent, about 0.3-1.5 wt % aluminum, about 0.5-2.0 wt % bismuth, about 61-66 wt % copper, about 0.0-0.5 wt % iron, about 11-15 wt % manganese, about 4.0-6.0 wt % nickel, about 0.5-2.0 wt % tin, and about 16-20 wt % zinc, as well as incidental amounts of impurities.

The invention additionally provides, among other things, a white bronze alloy comprising, in weight percent, about 1.0 wt % aluminum, about 1.0 wt % bismuth, about 63 wt % copper, about 12 wt % manganese, about 5.0 wt % nickel, about 1.0 wt % tin, and about 17 wt % zinc.

The invention additionally provides, among other things, a method of making a product with an antimicrobial surface comprising making the product from a white bronze alloy consisting essentially of, in weight percent, about 0.3-1.5 wt % aluminum, about 0.5-2.0 wt % bismuth, about 61-66 wt % copper, about 0.0-0.5 wt % iron, about 11-15 wt % manganese, about 4.0-6.0 wt % nickel, about 0.5-2.0 wt % tin, and about 16-20 wt % zinc, as well as incidental amounts of impurities.

Other aspects of the invention will become apparent by consideration of the detailed description.

DETAILED DESCRIPTION

The invention provides a white bronze alloy consisting essentially of, in weight percent, about 0.3-2.0 wt % aluminum, about 0.5-2.0 wt % bismuth, about 61-66 wt % copper, about 0.0-0.5 wt % iron, about 11-15 wt % manganese, about 4.0-6.0 wt % nickel, about 0.5-2.0 wt % tin, and about 16-20 wt % zinc, as well as incidental amounts of impurities. In a preferred embodiment, the alloy comprises, in weight percent, about 1.0 wt % aluminum, about 1.0 wt % bismuth, about 63 wt % copper, about 12 wt % manganese, about 5.0 wt % nickel, about 1.0 wt % tin, and about 17 wt % zinc. The trace impurities may include, but need not be limited to, antimony, arsenic, boron, cadmium, chromium, cobalt, lead, magnesium, phosphorus, selenium, silicon, silver, tellurium, titanium, and zirconium. Some alloys of the invention may have less than 5 ppm of one or more of these impurities, e.g., lead, arsenic, or cadmium, such that the alloys may be marketed as "lead-free," etc.

The alloys of the invention are valuable for a number of applications because they provide a clean appearance, similar to chrome-plated metals, and exhibit low galling (surface damage resulting from metal surfaces sliding past one another), while having a Brinell Hardness (3000 kg.) of greater than 80 HB, typically greater than 100 HB. The alloys of the invention additionally have desirable elongation (ASTM B 208 Standard Elongation Test: 2" test bar elongations of 15-20%) while possessing acceptable tensile strengths (greater than about 30,000 psi, typically greater than about 45,000 psi). The alloys are machineable with carbide tools, and can be machined at speeds and feed rates faster than those used for 304 stainless steel. During machining, the alloys form chips which are easily controlled and may be collected and recast.

Methods of making the alloys of the invention are known to those of skill in the art of metallurgy. The methods may include, but need not be limited to, melting copper and nickel in a melting vessel, adding (optionally) iron and manganese, and then bismuth and tin in the appropriate weight percents to achieve the alloy of the invention. Once the charge is completely molten, aluminum and zinc are added. The alloy is then heated to a casting temperature appropriate for the application. Other methods of preparing the alloy such as copper-alloy ingot smelting processes may also be used to prepare alloys of the invention.

Once melted, the alloys of the invention may be cast to form sheets, strips, plates, rods, bars, ingots, or tubes, or may be otherwise processed to create sheets, strips, plates, rods, bars, ingots, or tubes. The alloys may be cast or processed to form other materials common in the use of alloys, but not listed herein. All of these materials may be further machined, lathed, stamped, drawn, pulled, rolled, cut, etc., to form useful products including, but not limited to, knobs, handles, rails, poles, countertops, sinks, faucets, urinals, dispensers, pots, pans, utensils, and colanders.

Food processing equipment fabricated from the alloys of the invention may be used to form, grind, slice, spread or transport food. Such equipment includes, but need not be limited to, meat-grinders, meat/cheese slicers, mixers, bowls, pans, colanders', pots, food presses, food extruders, baking sheets, utensils, spreaders, and countertops. Foods produced with this equipment include, but are not limited to, chicken nuggets, burgers, pizza and bread dough, fish sticks, sausages, chopped and formed vegetables, candy, ice cream and frozen dairy items.

In addition to the clean appearance and low galling properties of the alloys of the invention, the alloys are expected to have antimicrobial properties due to the high copper content. That is, when a clean sheet of the alloy is exposed to bacteria, at least 90%, typically 99%, more typically 99.9% of the bacteria die within two hours. The alloys of the invention may exhibit antimicrobial properties against *Staphylococcus aureus, Escherichia coli, Pseudomonas aeruginosa, Listeria monocytogenes, Clostridium difficile*, and *Enterobacter aerogenes*, however it is expected that the alloys of the invention exhibit antimicrobial properties against many additional types of microbes. Because of the antimicrobial properties, it is expected that alloys of the invention may find wide use in hospitals, kitchens, bathrooms, slaughterhouses, meat-packing facilities, farms, feed mills, and laboratories, among other locations.

Because of the antimicrobial properties of the alloys of the invention, it is possible to make many products with antimicrobial properties. In most cases, creating an antimicrobial product or device is as simple as fabricating the product or device out of an alloy of the invention, so that a surface of the alloy is left to interact with the environment. For example, an antimicrobial handrail for a bathroom stall may be fabricated by making a handrail out of an alloy of the invention using known fabrication techniques. With regular cleaning the handrail may remain virtually free of *Clostridium difficile* which is commonly spread via fecal matter, and causes severe diarrhea and dehydration.

It is to be understood that the invention is not limited in its application to the details of construction and the arrangement of components set forth in the following description. The invention is capable of other embodiments and of being practiced or of being carried out in various ways. Also it is to be understood that the phraseology and terminology used herein is for the purpose of description and should not be regarded as limiting.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any nonclaimed element as essential to the practice of the invention.

It also is understood that any numerical range recited herein includes all values from the lower value to the upper value. For example, if a concentration range is stated as 1% to 50%, it is intended that values such as 2% to 40%, 10% to 30%, or 1% to 3%, etc., are expressly enumerated in this specification. These are only examples of what is specifically intended, and all possible combinations of numerical values between and including the lowest value and the highest value enumerated are to be considered to be expressly stated in this application.

Further, no admission is made that any reference, including any patent or patent document, cited in this specification constitutes prior art. In particular, it will be understood that, unless otherwise stated, reference to any document herein does not constitute an admission that any of these documents forms part of the common general knowledge in the art in the United States or in any other country. Any discussion of the references states what their authors assert, and the applicant reserves the right to challenge the accuracy and pertinency of any of the documents cited herein.

EXAMPLES

Example 1

White Bronze Alloy

A white manganese bronze alloy was prepared in accordance with the invention using an electric induction furnace to melt down and combine the following elements:

| Element | Weight Percent |
|---|---|
| Aluminum | 1.0 |
| bismuth | 1.0 |
| copper | 63.0 |
| manganese | 12.0 |
| nickel | 5.0 |
| tin | 1.0 |
| zinc | 17.0 |

The alloy was formed by charging copper and nickel into the bottom of the melting vessel followed by manganese. When the charge began melting, bismuth and tin were added, and heating was continued until the charge was completely molten. Before reaching the desired pouring temperature, the aluminum and zinc were added. The melt was then tapped into a pouring vessel and poured into molds to cast parts for testing as described below.

Example 2

Physical Properties of Alloys

The white bronze alloy of EXAMPLE 1 was compared to another copper alloy, MBAF 174, which is commonly used in the fabrication of food handling materials (G & W Electric Co., Blue Island, Ill.). The MBAF 174 alloy comprises, in weight percent, 1.1 wt % aluminum, 2.2 wt % bismuth, 55.5 wt % copper, 1.0 wt % iron, 12.0 wt % manganese, 5.5 wt % nickel, 1.7 wt % tin, and 21 wt % zinc. Table 1 shows that the alloy of EXAMPLE 1 exhibits a 16-17% reduction in the tensile and yield strength when compared to the MBAF 174 alloy. When compared to the MBAF 174 alloy, the alloy of EXAMPLE 1 also shows a reduced Brinell Hardness at 3000 kg. (MBAF 174=130 HB, EXAMPLE 1=112 HB). Compared to MBAF 174, however, the alloy of EXAMPLE 1 has increased elongation for a 2" test bar (MBAF 174=13%, EXAMPLE 1=18%).

TABLE 1

Comparison of typical tensile and yield strengths

| | MBAF 174 | EXAMPLE 1 |
|---|---|---|
| Tensile (PSI) | 55,000 | 46,000 |
| Yield (PSI) | 30,000 | 25,000 |

Example 3

Corrosion Resistance of Alloys

The alloy of EXAMPLE 1 was additionally tested for corrosion resistance and compared to the MBAF 174 alloy. The test data indicated that the alloy of EXAMPLE 1 is equal to, or better than, the MBAF 174 alloy with respect to corrosion resistance in a 6% sodium hypochlorite solution, especially over long periods. See TABLES 2 and 3. Resistance to hypochlorite exposure is especially important for alloys that will be used in food processing, because food processing equipment must be cleaned regularly with a bleach solution. The alloy of EXAMPLE 1 was additionally found to be inert to vinegar (14 days of vigorous agitation at 32° C.), household ammonia (7 days of vigorous agitation at 32° C.), and a 3% hydrogen peroxide solution (7 days of vigorous agitation at 32° C.).

TABLE 2

Corrosion tests for 1.25" diameter by 0.250" thick bars with 0.125" diameter hole in the middle. Each bar was soaked in 6.0% sodium hypochlorite (5.7% available chlorine) for 72 hours with mild agitation at 70° C.

| | MBAF 174 | EXAMPLE 1 |
|---|---|---|
| Starting Weight (g) | 41.1476 | 40.2010 |
| Ending Weight (g) | 40.4681 | 39.6100 |
| Difference (g) | 0.6795 | 0.5910 |
| | 1.6514% | 1.4701% |

TABLE 3

Corrosion tests for 1.25" diameter by 0.250" thick bars with 0.125" diameter hole in the middle. Each bar was soaked in 6.0% sodium hypochlorite (5.7% available chlorine) for 14 days with vigorous agitation at 32° C.

| | MBAF 174 | EXAMPLE 1 |
|---|---|---|
| Starting Weight (g) | 39.9859 | 40.6610 |
| Ending Weight (g) | 39.7098 | 40.4520 |
| Difference (g) | 0.2761 | 0.209 |
| | 0.690% | 0.514% |

PROPHETIC EXAMPLES

Example 4

Survival Rates for *Clostridium Difficile* on Alloy Surface

A 10 mm×10 mm sample of the alloy of EXAMPLE 1 ("sample") will be cut from 3 mm thick sheet stock. The sample will be degreased and cleaned by vortexing the sample in acetone along with 2 mm glass beads and then immersing the sample in 200 proof ethanol. Prior to testing, excess ethanol will be burned off with a Bunsen burner. As a control, a 10 mm×10 mm piece of 3 mm thick stainless steel ("control") will also be degreased and immersed in ethanol, and the excess ethanol burned off.

*Clostridium difficile* on glycerol protected beads (Fisher Scientific) will be incubated anaerobically with brain heart infusion broth (Oxoid) at 37° C. for 3-5 days to produce a culture of vegetative cells and spores for testing. Both the control and sample will have 20 μL of the *Clostridium difficile* culture pipetted onto their respective surfaces, and the control and sample will be incubated at room temperature for 2 hours. After two hours of incubation, 20 μL of a 5 mM solution of CTC (5-Cyano-2,3-ditolyl tetrazolium chloride; Sigma-Aldrich) will be deposited on the sample and the control, and the sample and control will be incubated in a dark, humid chamber for at 37° C. for 8 hours.

After rinsing the sample and control with sterile DI water to remove excess CTC stain, the sample and control will be imaged using epifluorescent microscopy, and a series of field views will be collected with a digital camera. A count of cells or spores in these field views will show that after two hours of incubation, the control sample had a great number of metabolically active cells or spore (e.g., CTC-stained) while the sample had less than 1% of the metabolically active cells or spores that were found on the control. The data will thus confirm that the alloy of EXAMPLE 1 kills at least 99% of *Clostridium difficile* within two hours.

Example 5

Survival Rates for *Listeria Monocytogenes* on Alloy Surface

As in EXAMPLE 4, a 10 mm×10 mm sample of the alloy of EXAMPLE 1 ("sample") will be cut from 3 mm thick sheet stock. The sample will be degreased and cleaned by vortexing the sample in acetone along with 2 mm glass beads and then immersing the sample in 200 proof ethanol. Prior to testing, excess ethanol will be burned off with a Bunsen burner. As a control, a 10 mm×10 mm piece of 3 mm thick stainless steel ("control") will also be degreased and immersed in ethanol, and the excess ethanol burned off.

*Listeria monocytogenes* Scott A from previously frozen microbeads (Centre for Applied Microbiology Research, Porton Down, UK) will be incubated with brain heart infusion broth (Oxoid) at 37° C. for 15-20 hours to produce an active culture for testing. Both the control and sample will have 20 μL of the *Listeria monocytogenes* culture pipetted onto their respective surfaces, and the control and sample will be incubated at room temperature for 2 hours. After two hours of incubation, 20 μL of a 5 mM solution of CTC (5-Cyano-2,3-ditolyl tetrazolium chloride; Sigma-Aldrich) will be deposited on the sample and the control, and the sample and control will be incubated in a dark, humid chamber for at 37° C. for 2 hours.

After rinsing the sample and control with sterile DI water to remove excess CTC stain, the sample and control will be imaged using epifluorescent microscopy, and a series of field views will be collected with a digital camera. A count of cells or in these field views will show that after two hours of incubation, the control sample had a great number of metabolically active cells (e.g., CTC-stained) while the sample had less than 1% of the metabolically active cells that were found on the control. The data will thus confirm that the alloy of EXAMPLE 1 kills at least 99% of *Listeria monocytogenes* within two hours.

Example 6

Survival Rates for Bacteria on Bathroom Handrails

A handrail, identical in size and shape to a commercial ADA-compliant handrail ("commercial handrail") will be fabricated from the alloy of EXAMPLE 1 ("alloy handrail"). The alloy handrail will be installed in a stall of a men's bathroom at an international airport. An adjoining stall, having a commercial handrail will be selected as the control. At 5:00 AM, both the alloy and commercial handrails will be thoroughly disinfected with a bleach solution, and rinsed with clean water. At 10:00 PM, after a full day of use, both handrails will be carefully removed from the stalls and bagged to prevent additional contamination.

The handrails will be taken to a laboratory, where the handrails will be sprayed with a 5 mM solution of CTC (5-Cyano-2,3-ditolyl tetrazolium chloride; Sigma-Aldrich)

under low-light conditions, and then allowed to incubate at 37° C. for 2 hours. After incubation, both handrails will be rinsed with sterile DI water. After air-drying, an ultraviolet lamp will be used to assess the fluorescence on both handrails, the fluorescence being indicative of the presence of active bacteria. The commercial handrail will show a substantially greater amount of fluorescence, indicating that after a full day of use, the alloy handrail had substantially fewer active bacteria on its surface.

Thus, the invention provides, among other things, a white copper alloy having antimicrobial properties. Various features and advantages of the invention are set forth in the following claims.

What is claimed is:

1. A white bronze alloy consisting of, in weight percent, about 0.3-1.5 wt % aluminum, about 0.5-2.0 wt % bismuth, about 61-66 wt % copper, about 11-15 wt % manganese, about 4.0-6.0 wt % nickel, about 0.5-2.0 wt % tin, and about 16-20 wt % zinc, as well as incidental amounts of impurities.

2. The white bronze alloy of claim 1, wherein a 2" test bar of the alloy elongates 15-20% using an ASTM B 208 test specimen.

3. The white bronze alloy of claim 1, wherein the alloy has a tensile strength greater than about 30,000 psi.

4. The white bronze alloy of claim 3, wherein the alloy has a tensile strength greater than about 45,000 psi.

5. The white bronze alloy of claim 1, wherein the alloy has a Brinell Hardness at 3000 kg of greater than 80 HB.

6. The white bronze alloy of claim 5, wherein the alloy has a Brinell Hardness at 3000 kg of greater than 100 HB.

7. A food handling product comprising the white bronze alloy of claim 1.

8. The food handing product of claim 7, wherein the food handling product is selected from the group consisting of meat-grinders, meat slicers, cheese slicers, mixers, bowls, pans, colanders, pots, food presses, food extruders, baking sheets, utensils, spreaders, and countertops.

9. A white bronze alloy consisting of, in weight percent, about 1.0 wt % aluminum, about 1.0 wt % bismuth, about 63 wt % copper, about 12 wt % manganese, about 5.0 wt % nickel, about 1.0 wt % tin, and about 17 wt % zinc, as well as incidental amounts of impurities.

* * * * *